US008092269B2

(12) United States Patent
Shibata et al.

(10) Patent No.: US 8,092,269 B2
(45) Date of Patent: Jan. 10, 2012

(54) METHOD OF MANUFACTURING SPARK PLUG

(75) Inventors: Tsutomu Shibata, Owariasahi (JP); Ryoji Kato, Inuyama (JP); Atsushi Tsukada, Yokkaichi (JP)

(73) Assignee: NGK Spark Plug Co., Ltd. (JP)

( * ) Notice: Subject to any disclaimer, the term of this patent is extended or adjusted under 35 U.S.C. 154(b) by 127 days.

(21) Appl. No.: 12/733,944

(22) PCT Filed: Mar. 23, 2009

(86) PCT No.: PCT/JP2009/055686

§ 371 (c)(1),
(2), (4) Date: Mar. 30, 2010

(87) PCT Pub. No.: WO2009/119517

PCT Pub. Date: Oct. 1, 2009

(65) Prior Publication Data

US 2010/0233929 A1 Sep. 16, 2010

(30) Foreign Application Priority Data

Mar. 24, 2008 (JP) ..... P2008-075677

(51) Int. Cl.
*H01T 21/02* (2006.01)
*H01T 21/00* (2006.01)

(52) U.S. Cl. ..... 445/7

(58) Field of Classification Search ..... 445/7
See application file for complete search history.

(56) References Cited

U.S. PATENT DOCUMENTS

| | | | | |
|---|---|---|---|---|
| 6,188,166 | B1 | 2/2001 | Nishikawa et al. | 313/141 |
| 6,328,619 | B1 * | 12/2001 | Shimizu et al. | 445/7 |
| 7,019,448 | B2 | 3/2006 | McMurray et al. | 313/141 |
| 7,059,926 | B2 | 6/2006 | McMurray et al. | 445/7 |
| 7,365,480 | B2 | 4/2008 | Honda et al. | 313/143 |
| 7,626,320 | B2 | 12/2009 | Shibata | 313/144 |
| 2010/0048083 | A1 * | 2/2010 | Shibata et al. | 445/7 |

OTHER PUBLICATIONS

Form PCT/ISA/210—Int'l Search Report (from corresponding Int'l Patent App. No. PCT/JP2009/055686) inluding Forms PCT/ISA/220 and PCT/ISA/237; 12 pages.

* cited by examiner

*Primary Examiner* — Mariceli Santiago
(74) *Attorney, Agent, or Firm* — Kusner & Jaffe

(57) ABSTRACT

A decrease in yield and degradation of productivity can be avoided when a spark plug having an insulator with low mechanical strength is manufactured. In a second process, a terminal electrode 15 is inserted to a predetermined position in a state where an insulator 12 is heated to a temperature equal to or greater than the softening temperatures of first to third powder materials 16P, 17P, and 18P such that the first powder material 16P becomes a first conductive sealing material layer 16, the second powder material 17P becomes a resistor 17, and the third powder material 18P becomes a second conductive sealing material layer 18. In addition, a speed at which the terminal electrode 15 is inserted is reduced between the start and the end of the second process.

8 Claims, 7 Drawing Sheets

METHOD OF MANUFACTURING SPARK PLUG

TECHNICAL FIELD

The present invention relates to a method for manufacturing a spark plug.

BACKGROUND ART

A manufacturing method of a spark plug is disclosed in Patent Document No. JP-A-2005-340171. The spark plug has a configuration including an insulator having a through-hole in an axial direction, a center electrode inserted into and fixed to a leading end side of the through-hole, a terminal electrode inserted into and fixed to a rear end side of the through-hole, a first conductive sealing material layer fixed to the center electrode in the through-hole, a second conductive sealing material layer fixed to the terminal electrode in the through-hole, and a resistor interposed between the first conductive sealing material layer and the second conductive sealing material layer in the through-hole and fixed to both conductive sealing material layers.

The spark plug is manufactured by the following two processes. First, in the first process, after inserting the center electrode into the leading end side of the through-hole, from the rear end side of the through-hole, predetermined amounts of a first powder material that is to be the first conductive sealing material layer, a second powder material that is to be the resistor, and a third powder material that is to be the second conductive sealing material layer are sequentially charged and compacted to cause solidification, and the terminal electrode is inserted from the rear end side of the through-hole until it abuts the third powder material and then stops.

Thereafter, in the second process, the terminal electrode is inserted to a predetermined position in a state where the insulator is heated to a temperature equal to or greater than the softening temperatures of the first to third powder materials. Accordingly, the first powder material becomes the first conductive sealing material layer, the second powder material becomes the resistor, and the third powder material becomes the second conductive sealing material layer.

In the case where the spark plug is manufactured as described above, since the first to third powder materials are compacted by the terminal electrode in the second process, a large amount of stress occurs in the insulator. Therefore, there is a concern that the insulator will suffer breakage. Recently, because a reduction in the size or diameter of the spark plug has been required, the thickness of the insulator has been reduced. As a result, the danger of this happening (i.e., breakage) is particularly high.

As a unit for avoiding insulator breakage, uniformly reducing the insertion speeds of the terminal electrode can be considered. However, in this case, although the decrease in yield due to breakage can be avoided, the time needed for the second process increases, so that productivity is degraded.

In order to solve the above-mentioned problems, it is an object of the invention to simultaneously avoid a decrease in yield due to breakage and degradation of productivity.

SUMMARY OF THE INVENTION

The present invention is a manufacturing method of a spark plug which includes an insulator having a through-hole in an axial direction, a center electrode inserted into and fixed to a leading end side of the through-hole, a terminal electrode inserted into and fixed to a rear end side of the through-hole, a first conductive sealing material layer fixed to the center electrode in the through-hole, a second conductive sealing material layer fixed to the terminal electrode in the through-hole, and a resistor interposed between the first and second conductive sealing material layers in the through-hole and fixed to both of them. The manufacturing method comprises:

a first process of inserting the center electrode into the leading end side of the through-hole, sequentially charging from the rear end side of the through-hole, predetermined amounts of a first powder material that is to be the first conductive sealing material layer, a second powder material that is to be the resistor, and a third powder material that is to be the second conductive sealing material layer to be compacted and solidified, and inserting the terminal electrode from the rear end side of the through-hole until the terminal electrode abuts the third powder material and stops; and a second process of inserting the terminal electrode to a predetermined position in a state where the insulator after finishing the first process is heated to a temperature equal to or greater than the softening temperatures of the first to third powder materials such that the first powder material becomes the first conductive sealing material layer, the second powder material becomes the resistor, and the third powder material becomes the second conductive sealing material layer, wherein a speed at which the terminal electrode is inserted is reduced from between the start and the end of the second process.

According to the manufacturing method of the invention, in the second process for compacting the first to third powder materials by the terminal electrode, the degree of compaction of the first to third powder materials increases as the end of the process gets closer, and the load exerted on the insulator increases. In this aspect, the speed at which the terminal electrode is inserted between the start and the end of the second process is reduced. That is, while the degree of compaction of the powder materials is low, there is no concern of breakage since the load exerted on the insulator is low, so that the degradation of productivity is suppressed by increasing the insertion speed of the terminal electrode. Then, when the degree of compaction of the powder materials is increased as the compaction step progresses, the increase in the load exerted on the insulator is suppressed by decreasing the insertion speed of the terminal electrode, thereby avoiding insulator breakage.

As described above, according to the invention, the decrease in yield and the degradation of productivity can be simultaneously avoided. Particularly, when attempts are made to decrease the size and diameter of the spark plug, the thickness of the insulator is reduced, and there is a concern regarding the degradation of mechanical strength. On this point, the manufacturing method according to the invention is effective.

In addition, as a scheme of controlling the insertion speed of the terminal electrode in the second process, a method of controlling the speed at a time between the start and the end, or controlling the speed according to a stroke of the terminal electrode between the start and the end may be employed.

In addition, as a scheme of decreasing the insertion speed of the terminal electrode in the second process, in addition to after inserting it at a first speed that is relatively high re-inserting it at a second speed that is lower than the first speed, a method of decreasing the speed in three or more steps, and continuously decreasing the speed from the start to the end of the second process may be employed. Besides, a step of maintaining the speed at a constant level, and a step of continuously decreasing the speed may be combined.

In the case of controlling the insertion speed of the terminal electrode in the second process at a time between the start and the end or according to a stroke of the terminal electrode, after the second process is set to include a first step of inserting the terminal electrode at a first speed and a second step of inserting the terminal electrode at a second speed that is lower than the first speed, a timing at which the first step is switched to the second step may be before a time point at which the second powder material reaches a length of the resistor while being compacted in the axial direction during the insertion of the terminal electrode.

Similarly, in the case of controlling the insertion speed of the terminal electrode in the second process at a time between the start and the end or according to a stroke of the terminal electrode, after the second process is set to include a first step of inserting the terminal electrode at a first speed and a second step of inserting the terminal electrode at a second speed that is lower than the first speed, a timing at which the first step is switched to the second step may be after a time point at which the terminal electrode is inserted by an amount of half its stroke between the start and the end of the second process.

In addition, as another scheme for controlling the speed in the second process, a method of controlling the speed on the basis of the reaction force during the insertion of the terminal electrode may be employed.

In this case, after the second process is set to include a first step of inserting the terminal electrode at a first speed and a second step of inserting the terminal electrode at a second speed that is lower than the first speed, a timing at which the first step is switched to the second step may be determined on the basis of the changed form of the reaction force accompanied by the progress of the insertion of the terminal electrode.

In addition, a driving mechanism for inserting the terminal electrode into the through-hole, a configuration of converting the rotation force of a servomotor to a linear motion using a ball screw mechanism to be transmitted to a press pin, a configuration of directly or indirectly pressing the press pin at the outer periphery of a cam rotated by the servomotor, or a configuration of transmitting an advancing or retreating movement of a rod of a hydraulic cylinder to the press pin may be employed, and by the configurations, the terminal electrode may be linearly advanced and retreated by using the press pin.

In addition, the driving mechanism for inserting the terminal electrode includes a plurality of press pins, and a single driving mechanism can manufacture a plurality of spark plugs.

DETAILED DESCRIPTION OF PREFERRED EMBODIMENTS

First Embodiment

Figure 1:
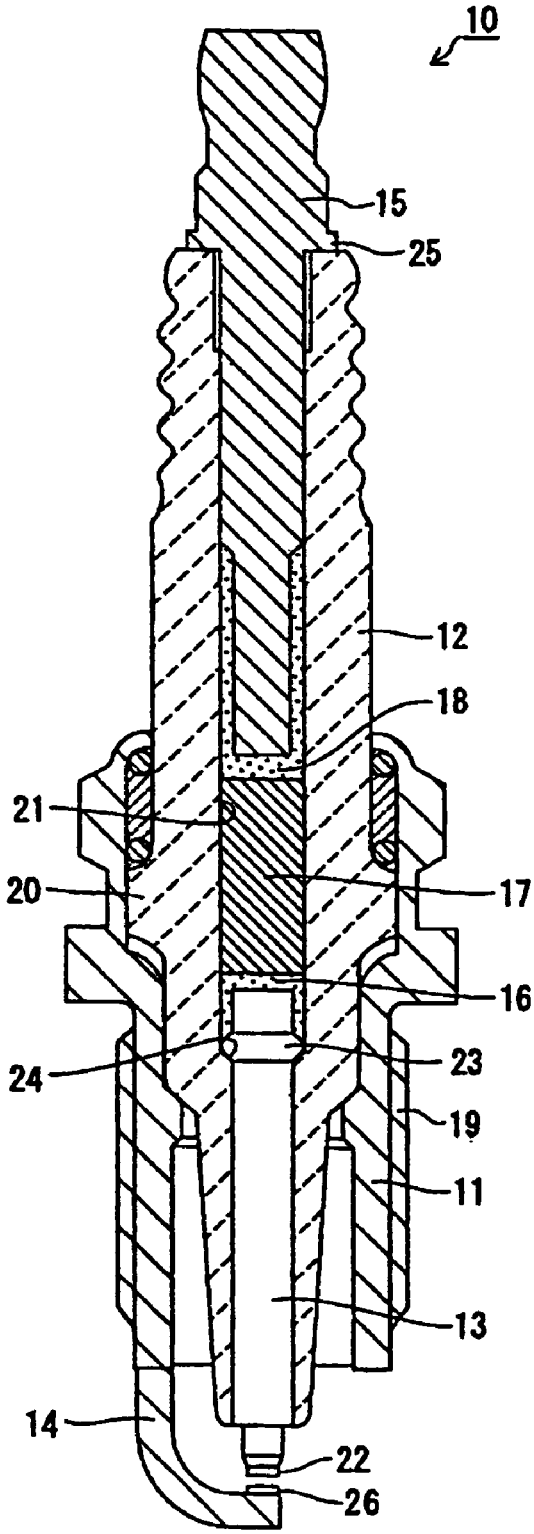
FIG. 1 is a sectional view of a spark plug according to a first embodiment.

Hereinafter, a first embodiment of the invention will be described with reference to FIGS. 1 to 5. A spark plug 10 of this embodiment illustrated in FIG. 1 includes a metal shell 11, an insulator 12, a center electrode 13, a ground electrode 14, a terminal electrode 15, a first conductive sealing material layer 16, a resistor 17, and a second conductive sealing material layer 18. In addition, in the following description, with respect to the upward and downward directions of the spark plug 10, a lower end in FIG. 1 is referred to as a leading end, and an upper end thereof is referred to as a rear end.

The metal shell 11 has a cylindrical shape with a hole penetrating vertically and is provided with a male thread 19 at its outer periphery for mounting the spark plug 10 to an engine block not shown. The insulator 12 is accommodated in the metal shell 11 such that its leading end portion protrudes from the metal shell 11. The insulator 12 has a hole penetrating vertically and is made of alumina ceramic. A flange 20 is formed at the outer periphery of the insulator 12, and the inside of the insulator 12 is provided with a through-hole 21.

In a lower end region of the through-hole 21, the center electrode 13 is provided such that an ignition portion 22 at its leading end protrudes from the insulator 12. The center electrode 13 is inserted into the through-hole 21 from the rear end side, and a diameter-increased portion 23 of its upper end portion is locked by a stepped receiving portion 24 of the through-hole 21 from above so that its position is determined while being restricted from coming off in a downward direction (leading end side). The ground electrode 14 is fixed to the lower end of the metal shell 11 by welding. An ignition portion 26 which is formed by bending a leading end portion of the ground electrode 14 and the ignition portion 22 of the center electrode 13 are opposed to each other vertically with a gap called a spark discharge gap interposed therebetween.

The terminal electrode 15 is accommodated in a substantially upper half section of the through-hole 21. The terminal electrode 15 is inserted into the through-hole 21 from the rear end side, and a collar portion 25 on its outer periphery is locked by a rear end surface of the insulator 12 such that its position is determined in a state where the relative movement (an insertion operation into the through-hole 21) toward the leading end side is restricted.

In a space between the rear end (the upper end in FIG. 1) of the center electrode 13 and the leading end (the lower end of FIG. 1) of the terminal electrode 15 in the through-hole 21 of the insulator 12, the first conductive sealing material layer 16, the resistor 17, and the second conductive sealing material layer 18 are sequentially charged from the leading end side.

The first conductive sealing material layer 16 is fixed to the center electrode 13 to be electrically connected thereto, and the second conductive sealing material layer 18 is fixed to the terminal electrode 15 to be electrically connected thereto. A portion of the first conductive sealing material layer 16 is intruded into a gap between the inner periphery of the through-hole 21 and the outer periphery of a rear end portion of the center electrode 13 for sealing, and a portion of the second conductive sealing material layer 18 is intruded into a gap between the inner periphery of the through-hole 21 and the outer periphery of a leading end portion of the terminal electrode 15 for sealing. In addition, a leading end portion of the resistor 17 interposed between the first and second conductive sealing material layers 16 and 18 is electrically connected to the center electrode 13 with the first conductive sealing material layer 16 interposed therebetween, and a rear end portion of the resistor 17 is electrically connected to the terminal electrode 15 with the second conductive sealing material layer 18 interposed therebetween.

Figure 2:
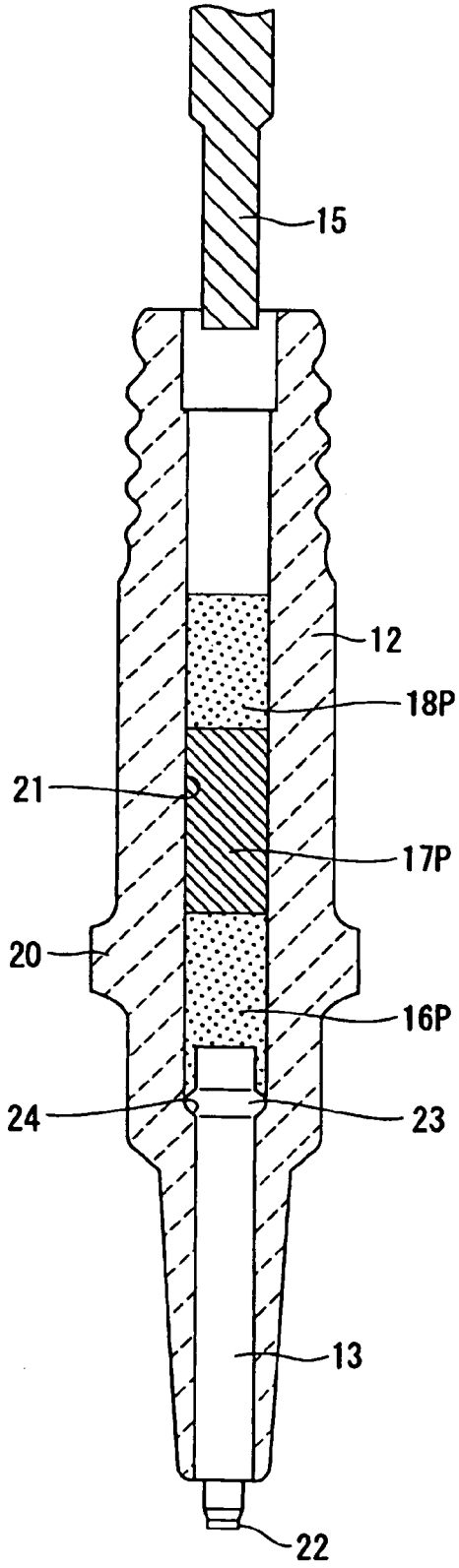
FIG. 2 is a sectional view showing a first process in a manufacturing process of the spark plug.

The first conductive sealing material layer 16 is, as illustrated in FIG. 2, formed by using a first powder material 16P as a raw material, which is a powder mixture of glass powder and a conductive filler (for example, metal powder mainly containing one or more kinds of metal components such as Cu and Fe) and heating and pressing this in a glass sealing step described later. As illustrated in FIG. 1, the resistor 17 is formed by using a second powder material 17P as a raw material, which is a powder mixture of glass powder and a conductive powder (and ceramic powder besides glass as needed) illustrated in FIG. 2 and heating and pressing this in the glass sealing step. As illustrated in FIG. 1, the second conductive sealing material layer 18 is, like the first conductive sealing material layer 16 illustrated in FIG. 2, formed by using a third powder material 18P as a raw material, which is a powder mixture of glass powder and a conductive filler (for example, metal powder mainly containing one or more kinds of metal components such as Cu and Fe) and heating and pressing this in the glass sealing step.

Figure 3:
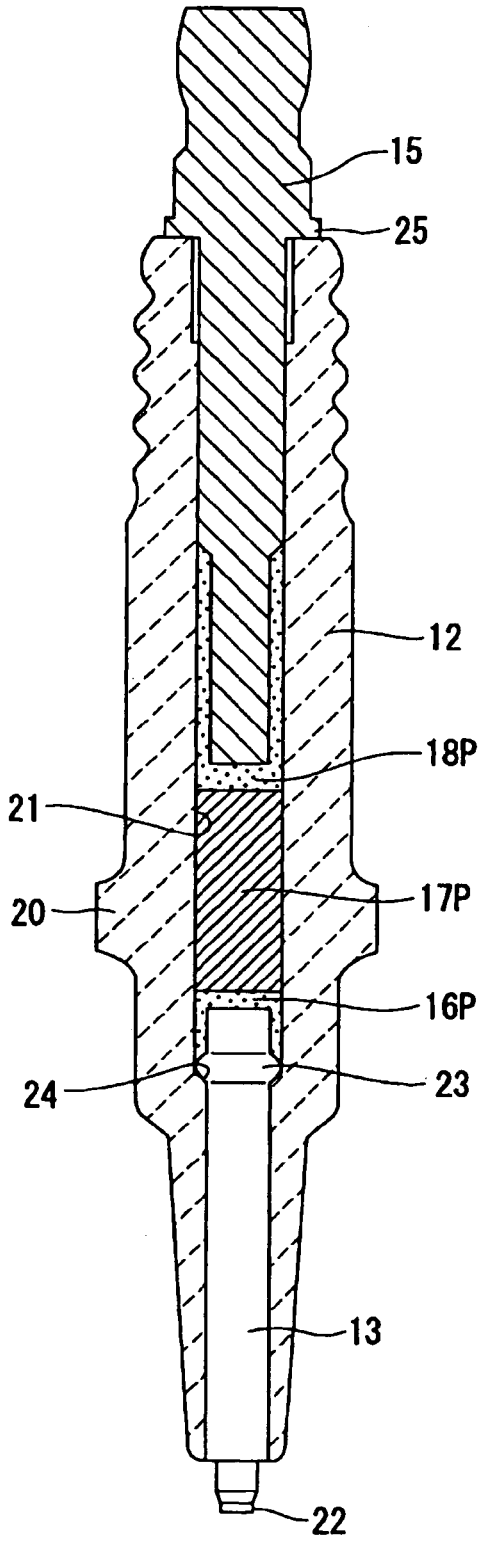
FIG. 3 is a sectional view showing a state where a second process is terminated in the manufacturing process of the spark plug.

Next, as illustrated in FIGS. 2 and 3, the glass sealing step for assembling the center electrode 13 and the terminal electrode 15 from the rear end side of the insulator 12, and forming the resistor 17 and the first and second conductive sealing material layers 16 and 18 will be described. The glass sealing step includes a first process before heating and pressing and a second process for heating and pressing after the first process. FIG. 2 illustrates a state right before inserting the terminal electrode 15 in the first process, and FIG. 3 illustrates a state where the second process is terminated.

The first process is, as illustrated in FIG. 2, performed by (1) inserting the center electrode 13 into the through-hole 21 of the insulator 12, (2) charging the first powder material 16P into the through-hole 21 and preliminarily compacting it to cause solidification, (3) charging the second powder material 17P and preliminarily compacting it to cause solidification, (4) charging the third powder material 18P and preliminarily compacting it to cause solidification, and (5) inserting the terminal electrode 15 to a predetermined press start position where it abuts the rear end of the third powder material 18P, sequentially. When the first process is completed, the first powder material 16P, the second powder material 17P, and the third powder material 18P are sequentially stacked from the rear end side.

Figure 4:
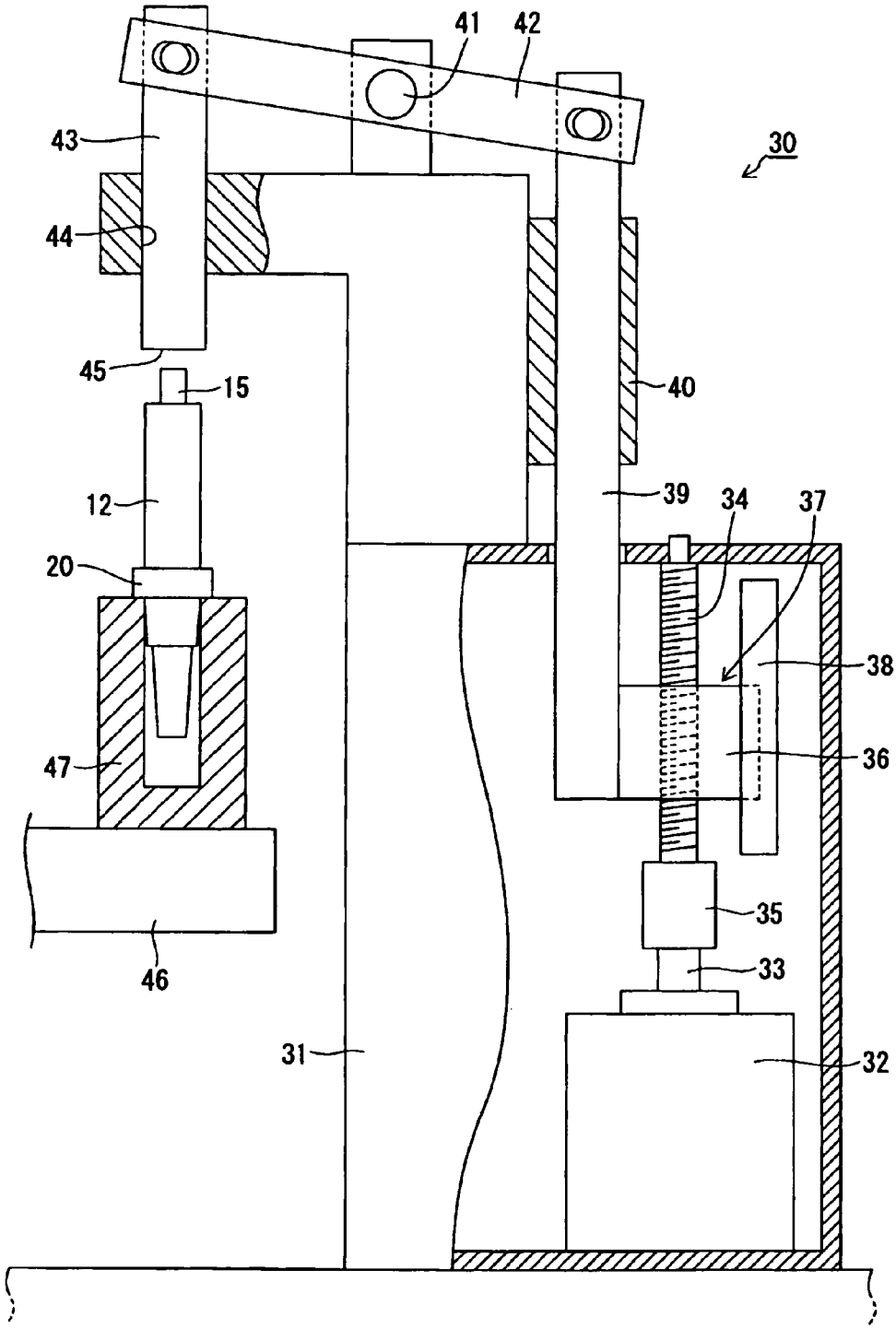
FIG. 4 is a sectional view showing a press apparatus for inserting a terminal electrode.

The second process is, as illustrated in FIG. 3, performed by (6) placing the first to third powder materials 16P, 17P, and 18P stacked in the through-hole 21 of the insulator 12 in a heating furnace not shown and heating them at a temperature (for example, 700 to 950° C.) higher than softening temperatures of the first to third powder materials 16P, 17P, and 18P, and (7) inserting the terminal electrode 15 at the press start position to a predetermined press completion position where the collar portion 25 comes in contact with the rear end surface of the insulator 12, using a press apparatus 30 illustrated in FIG. 4, sequentially. While the terminal electrode 15 is inserted from the press start position to the press completion position, the first to third powder materials 16P, 17P, and 18P heated to the softening temperatures are compacted between the center electrode 13 and the terminal electrode 15 in the vertical direction (the axial direction of the spark plug 10) such that the first powder material 16P becomes the first conductive sealing material layer 16, the second powder material 17P becomes the resistor 17, and the third powder material 18P becomes the second conductive sealing material layer 18.

Here, in the press apparatus 30 used for the second process, a servomotor 32 is fixed to a lower end portion of the frame 31 such that an output shaft 33 protrudes upward. A male threaded rod 34 having an axis along the vertical direction is connected to the output shaft 33 to rotate integrally with each other with a coupler 35 interposed therebetween. The male threaded rod 34 is screwed to a nut 36 provided with a ball (not shown) and a ball cycling pathway (not shown). The male threaded rod 34 and the nut 36 constitute a ball screw mechanism 37. The rotation of the nut 36 is restricted by a guide rail 38 that is parallel with the male threaded rod 34 and is moved in the vertical direction as the male threaded rod 34 rotates. The nut 36 is fixed to a lower end portion of a rod 39 in one body so as not to move vertically relative to the lower end portion. The rod 39 is guided by a guide unit 40 to move in the vertical direction.

An upper end portion of the frame 31 is provided with an arm 42 which is pivotable as a seesaw while being balanced on a pivot shaft 41 as a fulcrum which has an axis in a horizontal direction. One end portion of the arm 42 is connected to an upper end portion of the rod 39 by a connection mechanism configured by engaging a connection pin within an elongated hole (slot), and the other end portion of the arm 42 is connected to an upper end portion of a press pin 43 which is long in the vertical direction by a connection mechanism configured by engaging a connection pin within an elongated hole (slot). The press pin 43 is guided to penetrate through a guide hole 44 of the frame 31 so as to move only in the vertical direction. A lower end surface of the press pin 43 is configured as a pressing surface 45 for pressing the rear end surface (the upper end surface in FIG. 2) of the terminal electrode 15. A turntable 46 is provided below the press pin 43, and a holder 47 is provided on a top surface of the turntable 46. The holder 47 is held such that the leading end portion of the insulator 12 faces downward in a state where the flange 20 is locked by an upper end surface of the holder 47. When the turntable 46 is rotated, the insulator 12 is moved between a press position right below the press pin 43 and a retreat position deviating from the press position.

The insulator 12, heated in the operation (6) of the second process, is set in the holder 47 and moved to the press position by the rotation of the turntable 46, and the operation (7) is then performed. In the operation (7), the servomotor 32 is operated to rotate the male threaded rod 34 so as to move the nut 36 and the rod 39 upward, the press pin 43 is lowered through the arm 42, and thus the press pin 43 pushes the terminal electrode 15 from the press start position to the press completion position. After the operation (7) is terminated, the servomotor 32 is reversed to lower the nut 36 and the rod 39 so as to lift the press pin 43. Thereafter, the turntable 46 is rotated to move the insulator 12 to the retreat position, the insulator 12 is taken out of the holder 47, and the metal shell 11 and the center electrode 13 are assembled with the insulator 12, thereby completing the spark plug 10.

In the second process, from the start to the end, the lowering speed of the terminal electrode 15, that is, the insertion speed into the through-hole 21 is decreased. Specifically, in a first step that is the former part of the second process, the press pin 43 pushes the terminal electrode 15 down at a first speed that is relatively fast, and in a second step that is the latter part of the second process, it pushes the terminal electrode 15 down at a second speed that is constant and slower than the first speed.

In Table 1, results of experiments performed by changing the insertion speed and an insertion stroke of the terminal electrode 15 in the first step and the second step are shown as Examples A to E and Comparative Examples a to c. The evaluation results of a tact time (the total time needed for the first step and the second step, that is, the time to move the terminal electrode 15 in order to complete the operations for compacting the first to third powder materials 16P, 17P, and 18P) and a yield in each example are shown. In addition, in any example, the insertion stroke of the terminal electrode 15 was 10 mm.

TABLE 1

| | | First step | | | Second step | | | | | | |
|---|---|---|---|---|---|---|---|---|---|---|---|
| | | Speed (mm/sec) | Stroke (mm) | Time (sec) | Speed (mm/sec) | Stroke (mm) | Time (sec) | Tact time (sec) | | Yield | |
| Example | A | 100 | 8 | 0.08 | 10 | 2 | 0.20 | 0.28 | ○ | 100% | ○ |
| | B | 200 | 8 | 0.04 | 10 | 2 | 0.20 | 0.24 | ○ | 100% | ○ |
| | C | 100 | 8 | 0.08 | 50 | 2 | 0.04 | 0.12 | ○ | 100% | ○ |
| | D | 100 | 5 | 0.05 | 10 | 5 | 0.50 | 0.55 | ○ | 100% | ○ |
| | E | 200 | 5 | 0.025 | 10 | 5 | 0.50 | 0.53 | ○ | 100% | ○ |
| Compara- | a | 100 | 10 | 0.10 | — | — | — | 0.10 | ○ | 98% | X |
| tive | b | 10 | 10 | 1.00 | — | — | — | 1.00 | X | 100% | ○ |
| Example | c | 100 | 2 | 0.020 | 10 | 8 | 0.80 | 0.82 | Δ | 100% | ○ |

With regard to the tact time, "O" as the evaluation result represents good in terms of productivity, "X" represents not preferable in terms of productivity, and "Δ" represents not that good in terms of productivity. In addition, with regard to the yield, "O" represents good, and "X" represents bad. In Examples A to E, the evaluation results of "O" were obtained in regard to both the tact time and the yield. On the contrary, in Comparative Examples a to d, an evaluation of "Δ" or "X" was given in regard to the tact time and the yield.

More specifically, in Example A, the terminal electrode 15 was inserted at a first speed (denoted by "speed" in Table 1) of 100 mm/sec by 8 nun in the first step, and the terminal electrode 15 was inserted at a second speed of 10 mm/sec by 2 mm in the second step. In comparison between the first step and the second step, the ratio between the first speed and the second speed was 10:1, the ratio between the insertion strokes (denoted by "Stroke" in Table 1) was 4:1, and the ratio between consumed times was 2:5. As a result, the tact time was 0.28 sec, and the yield was 100%.

In Comparative Example a in which the terminal electrode 15 was inserted at a speed of 100 mm/sec from the start to the end of the second process, the tact time was 0.10 sec which is short. However, this results in a low yield of 98%. Therefore, Example A is superior to Comparative Example a in terms of yield. In Comparative Example b, the terminal electrode 15 was inserted at a relatively low speed of 10 mm/sec from the start to the end of the second process, so that the yield was 100% which is good. However, the tact time was 1.00 sec which is long. Therefore, the tact time in Example A was significantly short as compared with Comparative Example b.

In Comparative Example c, the insertion speeds (that is, the first speed and the second speed) of the first step and the second step were the same as those in Example A, and the insertion strokes of the first step and the second step were opposite to those in Example A. That is, in Comparative Example c, the insertion stroke of the first step of performing insertion at high speed was set to be short, and the insertion stroke of the second step of performing insertion at low speed was set to be long. Therefore, the tact time was longer than that in Example A by a corresponding amount, and the evaluation result stayed at "Δ".

In Example B, the insertion speed was twice that of the first step of Example A, so that the tact time was reduced by a corresponding amount as compared with Example A. Since the degree of compaction for the first, second, and third powder materials 16P, 17P, and 18P, that is, the load exerted on the insulator 12 was low in the first step, even when the insertion speed is high, there was no concern of the insulator 12 would suffer breakage, so that the evaluation result of the yield was "O".

In Example C, the insertion speed of the second step in which the load exerted on the insulator 12 increases was five times that of Example A. However, since the stroke of the terminal electrode 15 in the second step was 2 mm which is short, a time consumed for the second step was 0.04 sec which is very short, and the load was exerted on the insulator 12 only for an instant. Therefore, with the load and the time of those degrees, there was no concern the insulator 12 would suffer breakage.

In Example D, as compared with Example A, the insertion stroke of the first step in which the insertion speed is high was reduced from 8 mm to 5 mm, and the insertion stroke of the second step in which the insertion speed is low was increased from 2 mm to 5 mm, so that the tact time was twice that of Example A. However, as compared with Comparative Example b in which insertion was performed at a low constant speed of 10 mm/sec without changing the speed from the start to the end in the second process, and Comparative Example c in which the insertion stroke of the second step in which the insertion speed is low is set to be longer than the insertion stroke of the first step in which the insertion speed is high, the tact time of Example D was substantially half thereof, which is short.

In Example E, the insertion speed of the first step was twice that of Example D, that is, 200 mm/sec, and the tact time was reduced as compared with the Example D by the increase in speed.

Next, a control method for changing the insertion speed of the terminal electrode 15 in the first step and the second step will be described.

A first control method is based on the lapse of time from the start to the end of the second process to change the insertion speed. As an example, at the time of lowering the press pin 43 to the height at which the pressing surface 45 at its lower end comes in contact with the rear end surface (the upper end surface) of the terminal electrode 15, an operation of a counter for the first step of a control apparatus not shown is started, and after a predetermined time from this time point, the operation speed (that is, the rotation speed of the output shaft 33 and the male threaded rod 34) of the servomotor 32 is changed to a low speed. Then, at the time of changing to the low speed, an operation of a counter for the second step is started, and after a predetermined time from this time point, the servomotor 32 is stopped to stop inserting the terminal electrode 15. As a specific example of the control based on the lapse of time, for example, in the case of Example A of Table 1, at a time point of 0.08 sec after the first step is started, the insertion speed was changed from 100 mm/sec to 10 mm/sec.

As a second control method, the insertion speed may be changed on the basis of an insertion stroke from the press start position of the terminal electrode 15 between the start and the end of the second process. As an example, a sensor (for example, a limit switch or the like) for detecting the height of the press pin 43 is provided, the speed of the servomotor 32 is changed to a low speed on the basis of the detection signal from the sensor. As a specific example of the control based on the amount of the insertion stroke of the terminal electrode 15, for example, in the case of Example A of Table 1, when the press pin 43 and the terminal electrode 15 are lowered by 8 mm after the first step is started, the insertion speed is changed from 100 mm/sec to 10 mm/sec on the basis of the detection signal from the sensor.

As a third control method, at the time before the compaction dimension (vertical dimension) of the second powder material 17P compacted in the axial direction (vertical direction in FIGS. 1 and 4) of the spark plug 10 reaches the longitudinal dimension (vertical dimension) of the resistor 17, the insertion speed may be changed.

Figure 5:
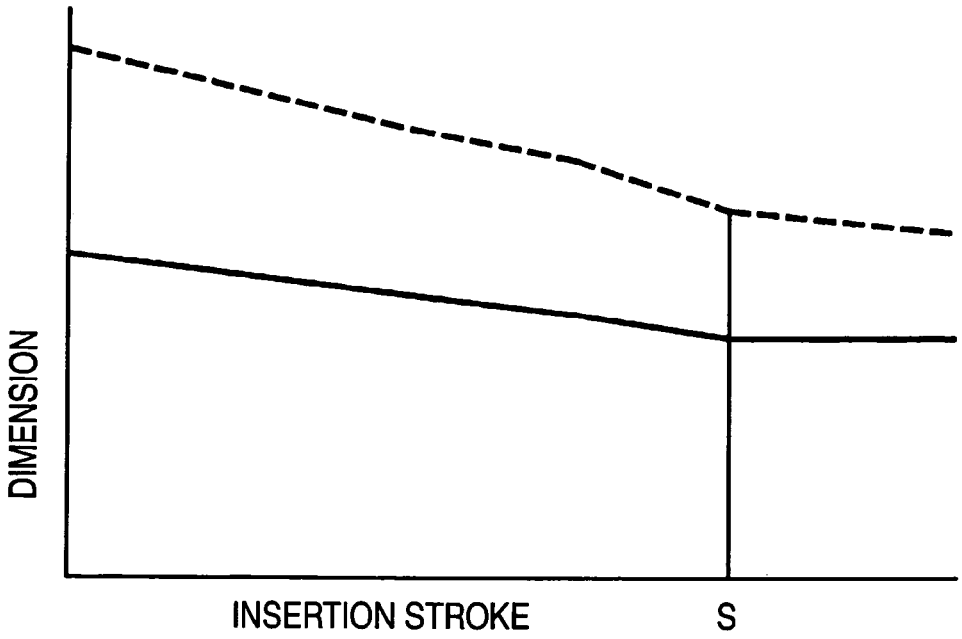
FIG. 5 is a graph showing a relationship between an insertion stroke of the terminal electrode, a compaction dimension of a second powder material, and a dimension between the terminal electrode and a center electrode.

The graph in FIG. 5 shows a relationship between the insertion stroke (horizontal axis) of the terminal electrode 15 in the second process, a dimension (vertical axis) from the rear end surface (upper end surface) of the center electrode 13 to the leading end surface (lower end surface) of the terminal electrode 15, and the compaction dimension of the second powder material 17P that is the raw material of the resistor 17. In this graph, a dotted line represents a dimension between electrodes, and a full line represents the compaction dimension of the second powder material 17P. A difference between the dimension between the electrodes and the compaction dimension of the second powder material 17P corresponds to the sum of the dimensions of the compacted first powder material 16P and the third powder material 18P.

As shown in this graph, in the second process, the dimension between the electrodes gradually decreases from the start to the end. On the contrary, although the compaction dimension of the second powder material 17P gradually decreases from the start of the second process, the decrease in the dimension stops before the end of the second process at the time point at which the insertion stroke of the terminal electrode 15 reaches S in the graph of FIG. 5. After this, even though the insertion of the terminal electrode 15 proceeds, the compaction dimension is maintained at a predetermined dimension (that is, the same dimension as the longitudinal dimension of the resistor 17) until the end of the second process. In addition, while the compact dimension of the second powder material 17P does not decrease but is constant, the sum of the dimensions of the first powder material 16P and the third powder material 18P decreases as the insertion of the terminal electrode 15 proceeds.

From the start to the end of the second process, since the sum of the dimensions of the first powder material 16P and the third powder material 18P is significantly smaller than the compaction dimension of the second powder material 17P, after the decrease in the compaction dimension stops (that is, after the compaction dimension reaches the longitudinal dimension of the resistor 17), the degree of the decrease in the sum of the dimensions of the first powder material 16P and the third powder material 18P significantly increases. This means that the load exerted on the insulator 12 significantly increases. In this aspect, in the third control method, before the compaction dimension of the second powder material 17P is the same as the longitudinal dimension of the resistor 17, the insertion speed of the terminal electrode 15 is changed from the high speed to the low speed. Accordingly, it is possible to achieve a reduction in the load exerted on the insulator 12.

In addition, since the second powder material 17P is accommodated in the insulator 12, the compaction dimension of the second powder material 17P cannot be directly detected from the outside of the insulator 12. Therefore, in order to perceive the relationship between the insertion stroke of the terminal electrode 15 and the compaction dimension, plural cut models obtained by partially cutting the insulator 12 in a state where the terminal electrode 15 was stopped in the course thereof were prepared according to the insertion strokes, and the compaction dimension of the second powder material 17P and the insertion stroke were measured for each cut model. In addition, on the basis of the measurement results obtained as described above, an insertion stroke suitable for changing the insertion speed of the terminal electrode 15 is determined.

In the first embodiment, in the second process for compacting the first, second, and third powder materials 16P, 17P, and 18P by inserting the terminal electrode 15 to the predetermined position in the insulator 12, the degree of compaction of the first, second, and third powder materials 16P, 17P, and 18P increases as the end of the step gets closer, and the load exerted on the insulator 12 increases. In this aspect, the speed at which the terminal electrode 15 is inserted between the start and the end of the second process was reduced. That is, while the degree of compaction of the first, second, and third powder materials 16P, 17P, and 18P was low, there was no concern regarding breakage since the load exerted on the insulator 12 is low, so that the degradation of productivity was suppressed by increasing the insertion speed of the terminal electrode 15. Then, when the degree of compaction of the first, second, and third powder materials 16P, 17P, and 18P was increased as the compaction step progresses the increase in the load exerted on the insulator 12 was suppressed by decreasing the insertion speed of the terminal electrode 15, thereby avoiding the breakage of the insulator 12. Accordingly, it is possible to avoid the decrease in yield and the degradation of productivity caused by the breakage of the insulator 12. It is preferable that the insertion speed of the first step be equal to or greater than 80 mm/sec, and the insertion of the second step be equal to or smaller than 50 mm/sec.

Second Embodiment

Next, a second embodiment of the invention will be described with reference to FIGS. 6 and 7. According to the second embodiment, the control method for changing the insertion speed of the terminal electrode 15 in the first step and the second step from the high speed to the low speed is different from that of the first embodiment, and a press apparatus 50 has a different configuration from that of the press apparatus 30 of the first embodiment according to this control method. Since other elements are the same as those of the first embodiment, like elements are denoted by like reference numerals, and a description of the structures, the operations, and the effects thereof will be omitted.

Figure 6:
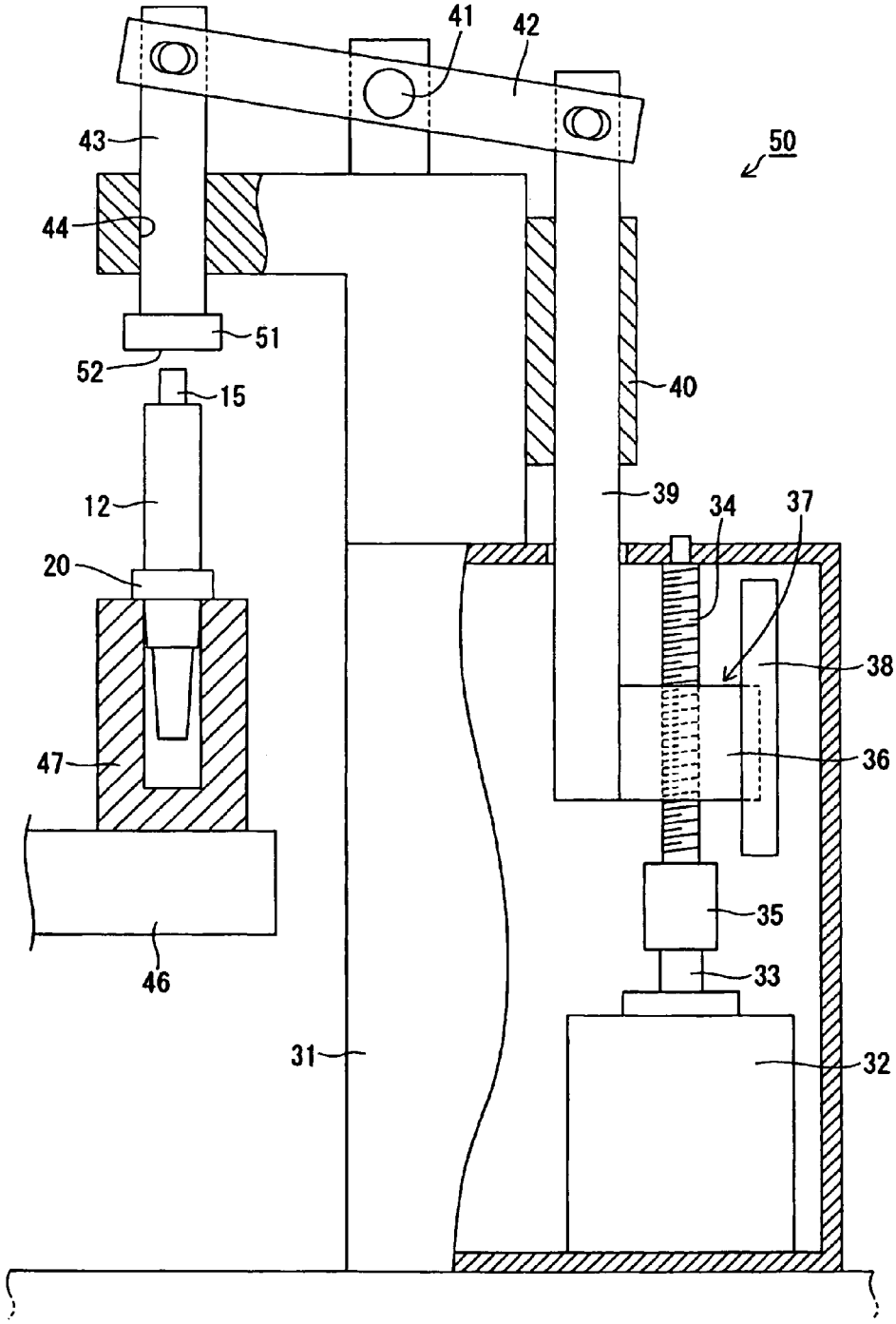
FIG. 6 is a sectional view showing a press apparatus for inserting a terminal electrode according to a second embodiment.

In the press apparatus 50 according to the second embodiment, as illustrated in FIG. 6, a load cell 51 is mounted to the lower end of the press pin 43, and a pressing surface 52 at the lower end of the load cell 51 presses the upper end surface (rear end surface) of the terminal electrode 15. As the first, second, and third powder materials 16P, 17P, and 18P are compacted by inserting the terminal electrode 15 into the insulator 12 due to the pressing operation of the load cell 51, the reaction force from the first, second, and third powder materials 16P, 17P, and 18P is exerted on the pressing surface 52 of the load cell 51 with the terminal electrode 15 interposed therebetween. The load cell 51 outputs an electrical signal corresponding to the load exerted on the pressing surface 52, and on the basis of the electrical signal, the operation of the servomotor 32, that is, the lowering speed of the load cell 51 is controlled.

Figure 7:
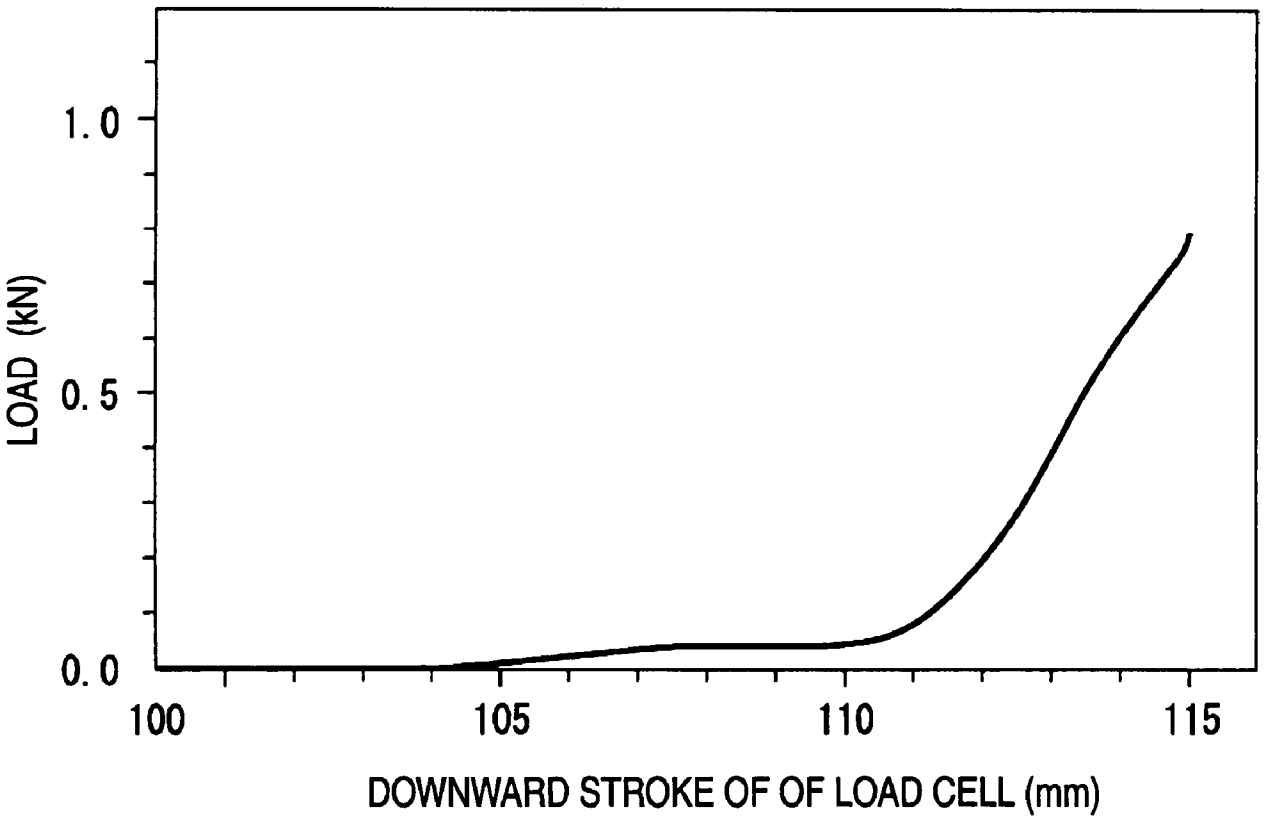
FIG. 7 is a graph showing a relationship between a downward stroke of a load cell for inserting the terminal electrode and a load exerted on the load cell.

The graph of FIG. 7 shows an example of the relationship between the downward stroke (horizontal axis) of the load cell 51 and the load (vertical axis) exerted on the load cell 51. When the load cell 51 is lowered by 104 mm from the origin, the pressing surface 52 of the load cell 51 comes in contact with the rear end surface of the terminal electrode 15, and the load cell 51 and the terminal electrode 15 are then lowered integrally to compact the first, second, and third powder materials 16P, 17P, and 18P. When the downward stroke reaches 115 mm, the lowering of the load cell 51 and the terminal electrode 15 is terminated. Therefore, the insertion stroke from the insertion start to the insertion completion of the terminal electrode 15 is 11 mm.

When the downward stroke of the load cell 51 is between 104 and 108 mm, the load slightly increases, and when the downward stroke is between 108 and 110 mm, a relatively low load of about 0.04 kN is maintained. So far, the load exerted on the insulator 12 is relatively low. When the downward stroke is above 11 mm, the load exerted on the load cell 51, that is, the load exerted on the insulator 12 significantly increases. In this aspect, it is preferable that changing the insertion speed of the terminal electrode 15 be performed before the load exerted on the load cell 51 suddenly increases. As a specific example, the speed may be changed at the time point at which the load exerted on the load cell 51 reaches, for example, 0.1 kN.

While the invention has been described above with reference to the exemplary embodiments thereof, the invention is not limited to the embodiments, and various modifications can be made without departing from the spirit and scope of the invention. As an example, it can be thought that the insertion speed of the terminal electrode 15 is changed according to a history of the reaction force acquired from the load cell 51 by using the load cell 51 of the second embodiment. As a specific method of changing the speed according to the history of the reaction force, the reaction force is acquired every predetermined time during the operation of inserting the terminal electrode 15, the acquired values of the reaction force are integrated (or differentiated), the integral value (or the differential value) is compared with a reference value set in advance, and the insertion speed of the terminal electrode 15 may be changed in a condition where the integral value (or the differential value) is above the reference value.

While the invention has been described in detail with reference to the embodiments, it should be understood by those skilled in the art that various alternations and modifications can be made without departing from the spirit and scope of the invention.

The invention claimed is:

1. A manufacturing method of a spark plug which includes an insulator having a through-hole in an axial direction, a center electrode inserted into and fixed to a leading end side of the through-hole, a terminal electrode inserted into and fixed to a rear end side of the through-hole, a first conductive sealing material layer fixed to the center electrode in the through-hole, a second conductive sealing material layer fixed to the terminal electrode in the through-hole, and a resistor interposed between the first and second conductive sealing material layers in the through-hole and fixed to both of them, the manufacturing method comprising:

a first process of inserting the center electrode into the leading end side of the through-hole, sequentially charging from the rear end side of the through-hole, predetermined amounts of a first powder material that is to be the first conductive sealing material layer, a second powder material that is to be the resistor, and a third powder material that is to be the second conductive sealing material layer to be compacted and solidified, and inserting the terminal electrode from the rear end side of the through-hole until the terminal electrode abuts the third powder material and stops; and a second process of inserting the terminal electrode to a predetermined position in a state where the insulator after finishing the first process is heated to a temperature equal to or greater than the softening temperatures of the first to third powder materials such that the first powder material becomes the first conductive sealing material layer, the second powder material becomes the resistor, and the third powder material becomes the second conductive sealing material layer, wherein a speed at which the terminal electrode is inserted is reduced from between the start and the end of the second process.

2. The manufacturing method according to claim 1, wherein the speed is controlled based on a time between the start and the end of the second process.

3. The manufacturing method according to claim 1, wherein the speed is controlled based on a stroke of the terminal electrode between the start and the end of the second process.

4. The manufacturing method according to claim 1, wherein the speed is controlled based on the reaction force during the insertion of the terminal electrode in the second process.

5. The manufacturing method according to claim 1, wherein the second process includes:

a first step of inserting the terminal electrode at a first speed; and a second step of inserting the terminal electrode at a second speed that is lower than the first speed.

6. The manufacturing method according to claim 2, wherein the second process includes:

a first step of inserting the terminal electrode at a first step; and a second step of inserting the terminal electrode at a second speed that is lower than the first speed, and wherein a timing at which the first step is switched to the second step is before a time point at which the second powder material reaches a length of the resistor while being compacted in the axial direction during the insertion of the terminal electrode.

7. The manufacturing method according to claim 2, wherein the second process includes:

a first step of inserting the terminal electrode at a first step; and a second step of inserting the terminal electrode at a second speed that is lower than the first speed, and wherein a timing at which the first step is switched to the second step is after a time point at which the terminal electrode is inserted by an amount of half its stroke between the start and the end of the second process.

8. The manufacturing method according to claim 4, wherein the second process includes:

a first step of inserting the terminal electrode at a first step; and a second step of inserting the terminal electrode at a second speed that is lower than the first speed, and wherein a timing at which the first step is switched to the second step is determined based on the changing form of the reaction force accompanied by the progress of the insertion of the terminal electrode.

* * * * *